United States Patent [19]

Harder

[11] Patent Number: 4,624,099

[45] Date of Patent: Nov. 25, 1986

[54] PACKAGING APPARATUS FOR MAKING GAS-FILLED PACKAGES FROM PLASTIC FILM

[75] Inventor: John R. Harder, Cedar Grove, N.J.

[73] Assignee: Mahaffy & Harder Engineering Co., Fairfield, N.J.

[21] Appl. No.: 137,628

[22] Filed: Apr. 7, 1980

[51] Int. Cl.[4] ..... B65B 31/02

[52] U.S. Cl. ..... 53/432; 53/485; 53/510; 53/282; 53/313

[58] Field of Search ..... 53/433, 453, 87, 89, 53/90, 94, 167, 510, 511, 432, 282, 313, 485; 141/7, 70; 239/524

[56] References Cited

U.S. PATENT DOCUMENTS

| | | | |
|---|---|---|---|
| 724,685 | 4/1903 | Evans | 239/524 X |
| 2,815,621 | 12/1957 | Carter | 141/7 |
| 2,869,300 | 1/1959 | Stover | 53/313 |
| 3,061,984 | 11/1962 | Mahaffy | 53/511 X |
| 3,347,011 | 10/1967 | Lovas | 53/433 |
| 3,354,608 | 11/1967 | Hart | 53/87 |
| 3,397,842 | 8/1968 | Frandsen | 239/524 X |
| 3,421,554 | 1/1969 | Carter | 141/7 |
| 3,524,298 | 8/1970 | Hamilton | 53/511 X |
| 3,530,641 | 9/1970 | Bergstrom | 53/167 |
| 3,557,517 | 1/1971 | Limmer | 53/511 X |
| 3,744,210 | 7/1973 | O'Lenick | 53/511 X |
| 3,745,742 | 7/1973 | Tartarini | 53/511 |
| 4,162,599 | 7/1979 | Kyle | 53/511 X |
| 4,165,594 | 8/1979 | Corbic | 53/167 |

*Primary Examiner*—John Sipos

*Attorney, Agent, or Firm*—Parmelee, Bollinger & Bramblett

[57] ABSTRACT

A packaging machine wherein product-loaded cup-shaped receptacles are advanced with an indexing movement through a series of packaging stations. One station includes a fixed vacuum/gas chamber extending entirely over one set of receptacles. The receptacles are first evacuated through this fixed chamber, and thereafter gas is directed into the chamber to fill the receptacles. A fine wire-mesh screen is positioned between the chamber and the receptacles to constrain the air and gas flow to a vertical direction, to prevent disarrangement of the product during evacuation and gassing. A gas-curtain structure develops an enclosed region of gas above the receptacles during their movement out from under the fixed chamber over to the final sealing station. The sealing operation takes place in two successive steps within the sealing station.

11 Claims, 12 Drawing Figures

PACKAGING APPARATUS FOR MAKING GAS-FILLED PACKAGES FROM PLASTIC FILM

BACKGROUND OF THE INVENTION

1. Field of the Invention

This invention relates to packaging apparatus and to methods carried out by such apparatus. More particularly, this invention relates to methods and apparatus for making evacuated, hermetically-sealed packages from plastic film, and for making such packages containing an inert gas such as nitrogen.

2. Description of the Prior Art

It is well known in the prior art to make hermetically-sealed packages from plastic film. Such packages typically may be evacuated prior to sealing, for example, to increase the shelf life of food products. For certain types of products, it also has been found desirable to introduce an inert gas into the package before sealing.

Various types of automatic packaging machines designed to make hermetically-sealed packages have been available for a number of years. Reference may be made in that regard to U.S. Pat. Nos. 3,061,984 and 3,524,298. Although such machines have been quite satisfactory for most packaging applications, problems have occurred when using conventional machines for packaging products of the type with top layers comprising liquid or semi-liquid materials, i.e. products having portions which are relatively non-cohesive. For example, when the product consists of a portion of solid food material covered with a topping consisting of a layer of liquid or semi-liquid sauce, sprinkled with a ground condiment, it has been found that in conventional machines the rapid flow of air and gas during evacuation and/or gas-filling tends to shift and disarrange the topping of the product. Such disarrangement of the product destroys its aesthetic appearance, making it unattractive to prospective customers. Moreover, rapid flow of air and/or gas across the product can drive the liquid or semi-liquid product material out of the container receptacle and onto the flange sealing surfaces around the mouth of the receptacle, thereby interfering with the efficacy of the seal and resulting in leaky packages.

Such problems can of course be minimized simply by reducing the rate of flow of air or gas, but that in turn undesirably restricts the rate of package production.

SUMMARY OF THE INVENTION

In one preferred embodiment of the invention, to be described hereinbelow in detail, the product-containing receptacle is positioned with its mouth facing upwardly beneath a fixed vacuum/gas chamber having a corresponding downwardly-facing opening. The receptacle is formed with flanges surrounding the open mouth, and these flanges are sealingly pressed up against corresponding surfaces of the fixed chamber. Vacuum then is applied to the fixed chamber to evacuate the receptacle through the chamber opening. An inert gas thereafter is applied through the chamber opening into the receptacle, to effect the desired level of gas filling.

The gas-filled receptacle then is moved out from beneath the fixed vacuum/gas chamber towards the next operating station. During this movement a plastic film is laid down over the mouth of the receptacle to serve as a top thereby forming a container which, although as yet unsealed, is substantially closed from atmosphere so as to tend to prevent escape of the gas. In a subsequent packaging station, this top film is heat-sealed to the flanges around the receptacle mouth thereby to create a completed, gas-filled, hermetically-sealed package.

The packaging apparatus is so arranged that during evacuation the air originally in the receptacle is drawn essentially vertically up away from the product, (i.e. perpendicular to the product surface), thus avoiding lateral flow streams which would tend to disarrange the product. Correspondingly, the inert gas is caused to flow into the receptacle in an essentially vertical downward direction, thereby also avoiding disarrangement of the product during that portion of the cycle. Establishing such vertical air and gas flow paths is achieved in the preferred embodiment by the use of a fine wire-mesh screen positioned between the mouth of the receptacle and the bottom of the vacuum/gas chamber. This screen constrains both upward and downward gaseous fluid flows to flow streams which are substantially perpendicular to the surface of the product in the receptacle.

In accordance with still another important aspect of the invention, special means are provided to maintain proper gas levels in the receptacle while it is being moved from beneath the fixed vacuum/gas chamber to the subsequent sealing station. In the preferred embodiment, such special means comprises means to develop a continuous protective curtain of gas above the receptacle while it moves out from under the fixed vacuum/gas chamber.

Accordingly, it is an object of the invention to effect evacuation and/or gas-filling of a package without causing disarrangement of portions of the packaged product. Other objects, aspects, and advantages of the invention will in part be pointed out in, and in part apparent from, the following description of a preferred embodiment of the invention considered together with the accompanying drawings.

DESCRIPTION OF A PREFERRED EMBODIMENT

Figures 1, 6:
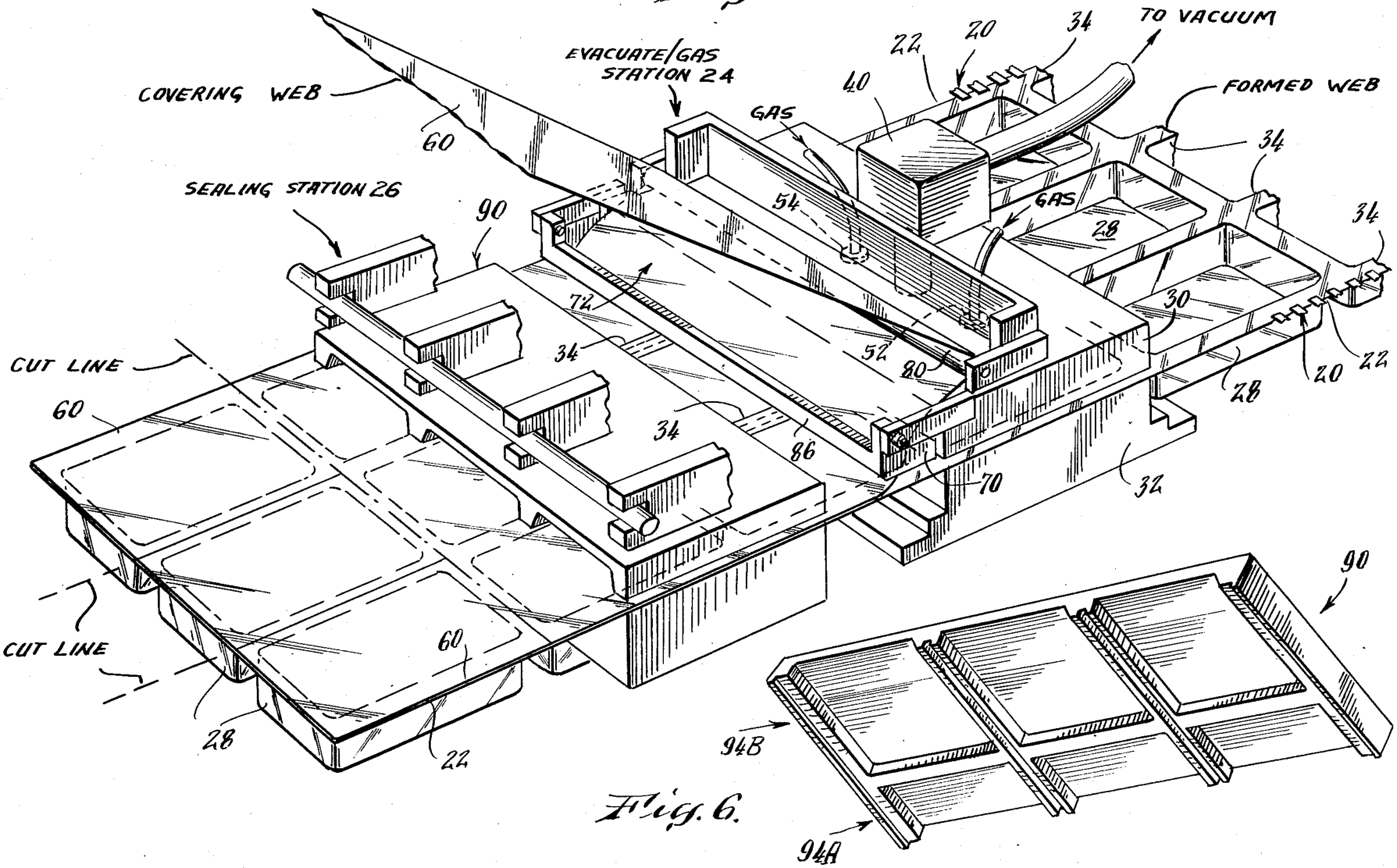
FIG. 1 is a perspective view showing diagrammatically the principal components of a packaging machine in accordance with this invention.
FIG. 6 is a perspective view showing the sealing bar configuration.
Figure 2:
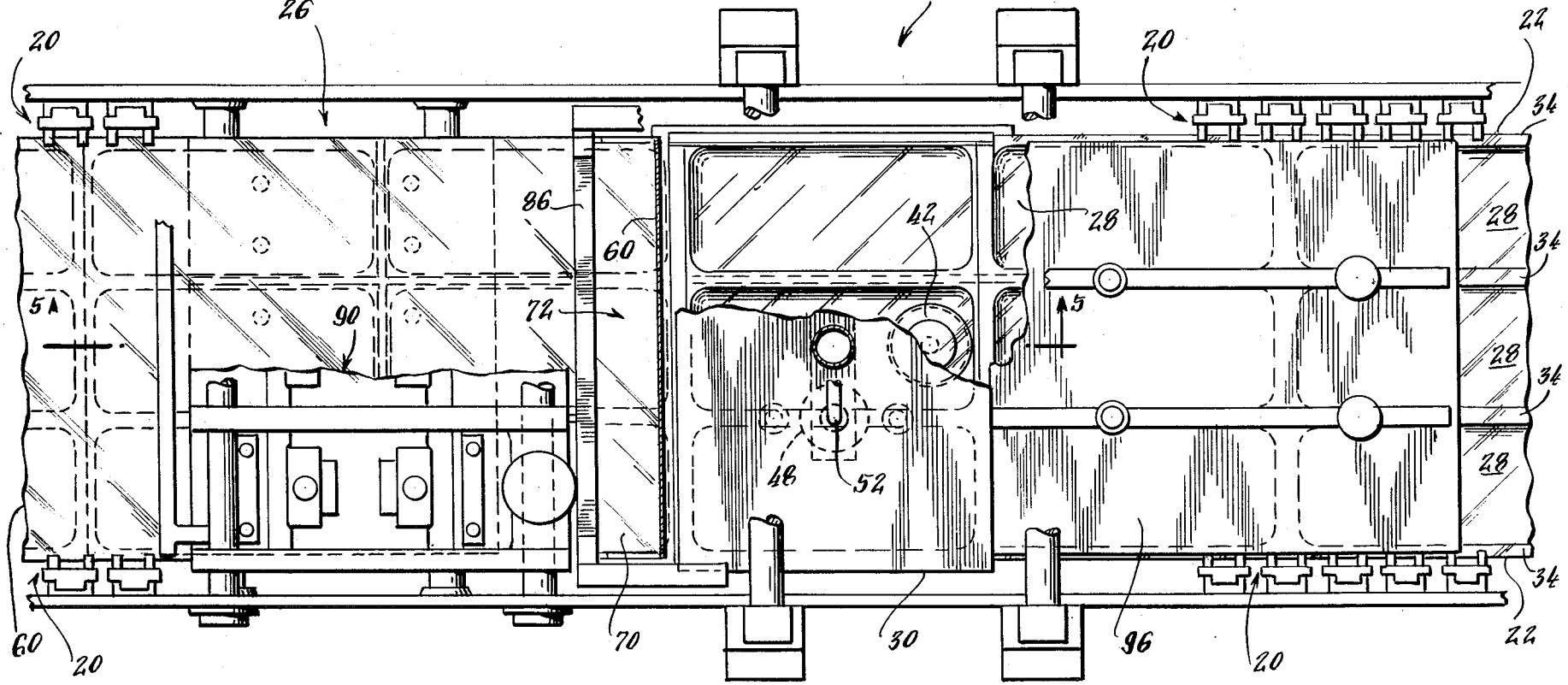
FIG. 2 is a plan view of the principal packaging stations of the machine shown generally in FIG. 1.
Figure 4:
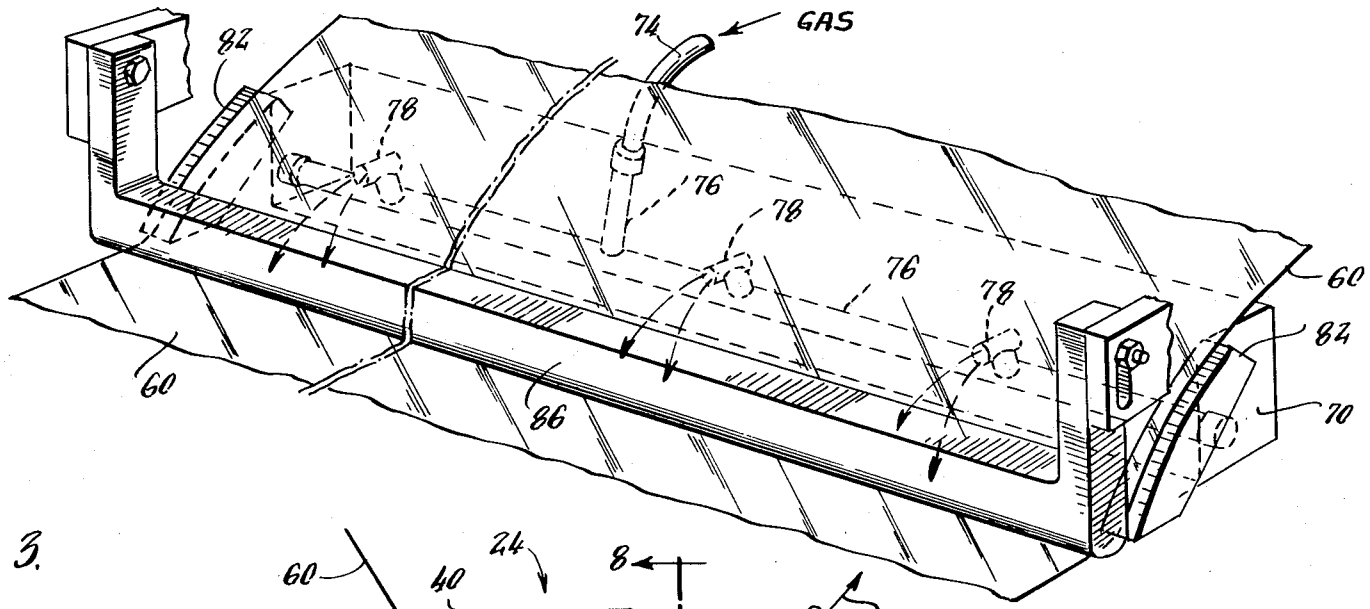
FIG. 4 is a perspective view showing the gas curtain arrangement for maintaining proper gas levels in the package while it is being moved from one station to the next.

Referring now to FIGS. 1 and 2, the apparatus in accordance with the present invention includes conventional chain-driven clamp means 20 to convey a plastic web 22 along a horizontal path passing through a series of packaging stations. Two of the packaging stations are generally indicated at 24 and 26. Prior to entry into these stations, the web is formed by known means (not shown herein) into cup-shaped pockets 28 serving as receptacles for the product to be packaged.

In the machine illustrated herein, the web 22 is moved with an intermittent indexing movement, with each indexing step being equal in size to the length of the receptacles. Each repeat of the web in this machine is formed with three side-by-side receptacles, although other receptacle arrangements can be used where appropriate to the particular application.

Figure 3:
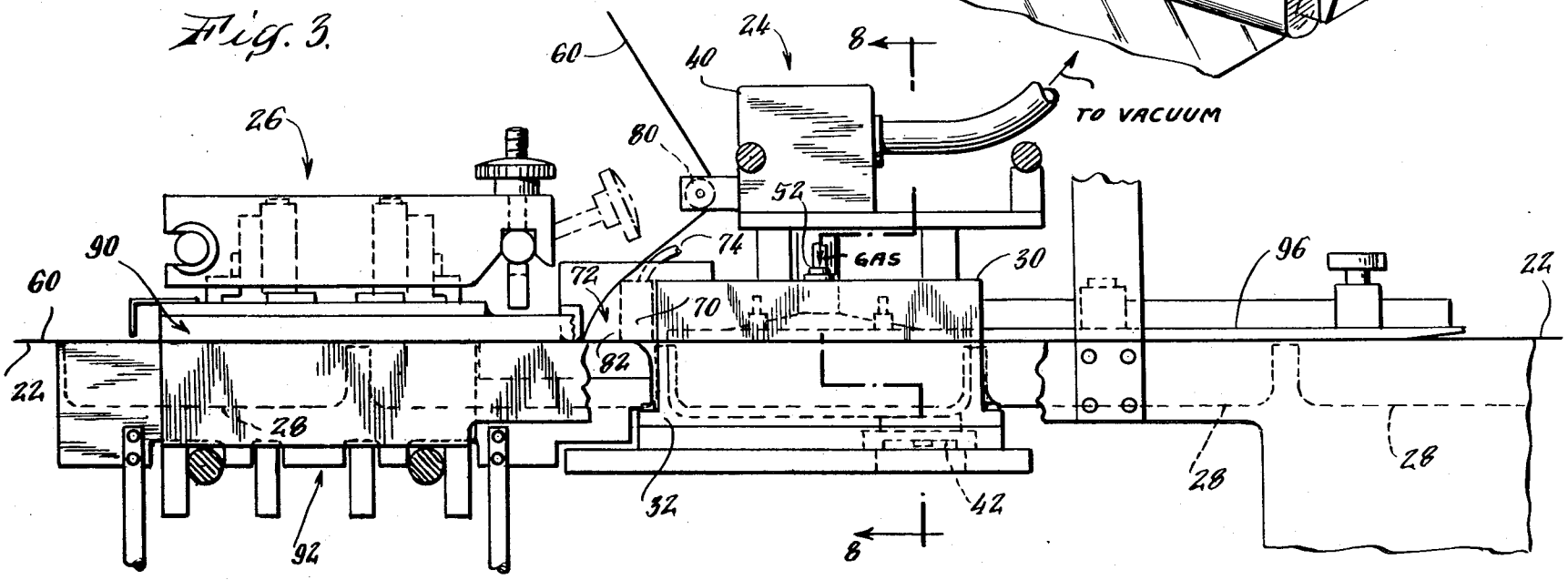
FIG. 3 is a side elevation of the principal packaging stations illustrated in FIG. 2.
Figure 7:
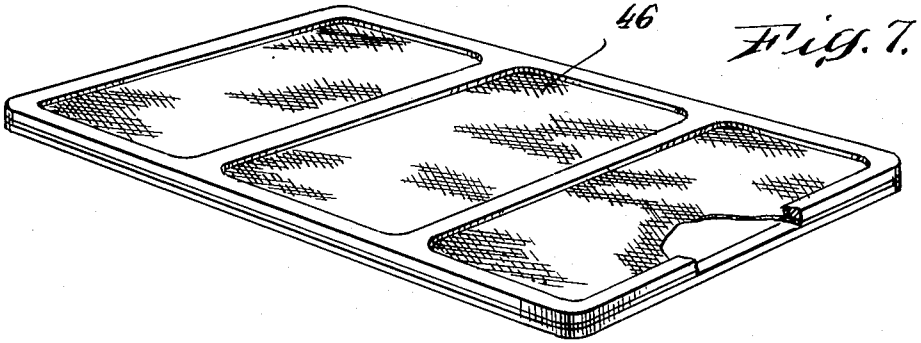
FIG. 7 is a perspective view showing the air/gas flow-controlling screen.
Figure 5:
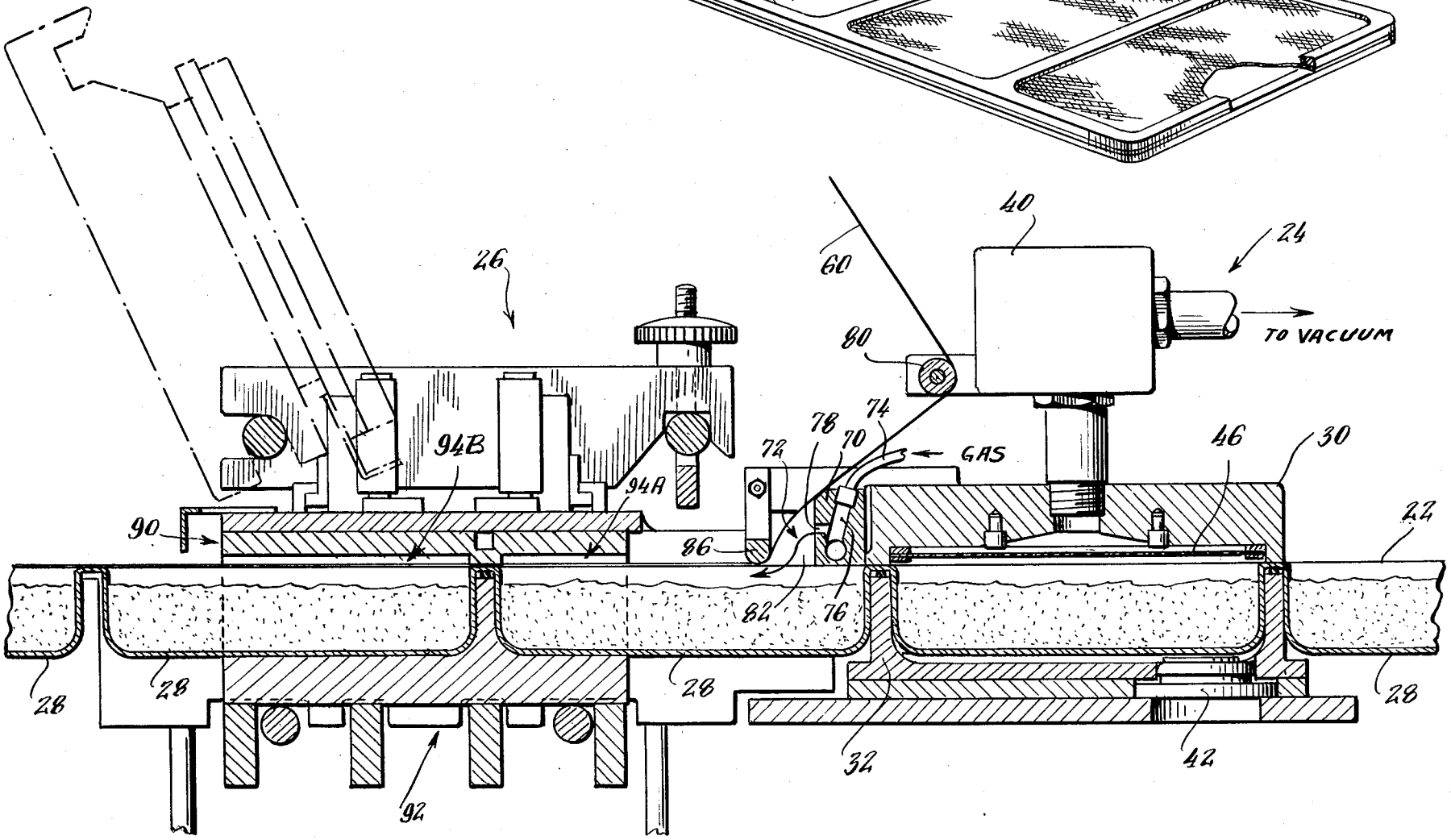
FIG. 5 is a longitudinal section of the packaging machine.
Figure 8:
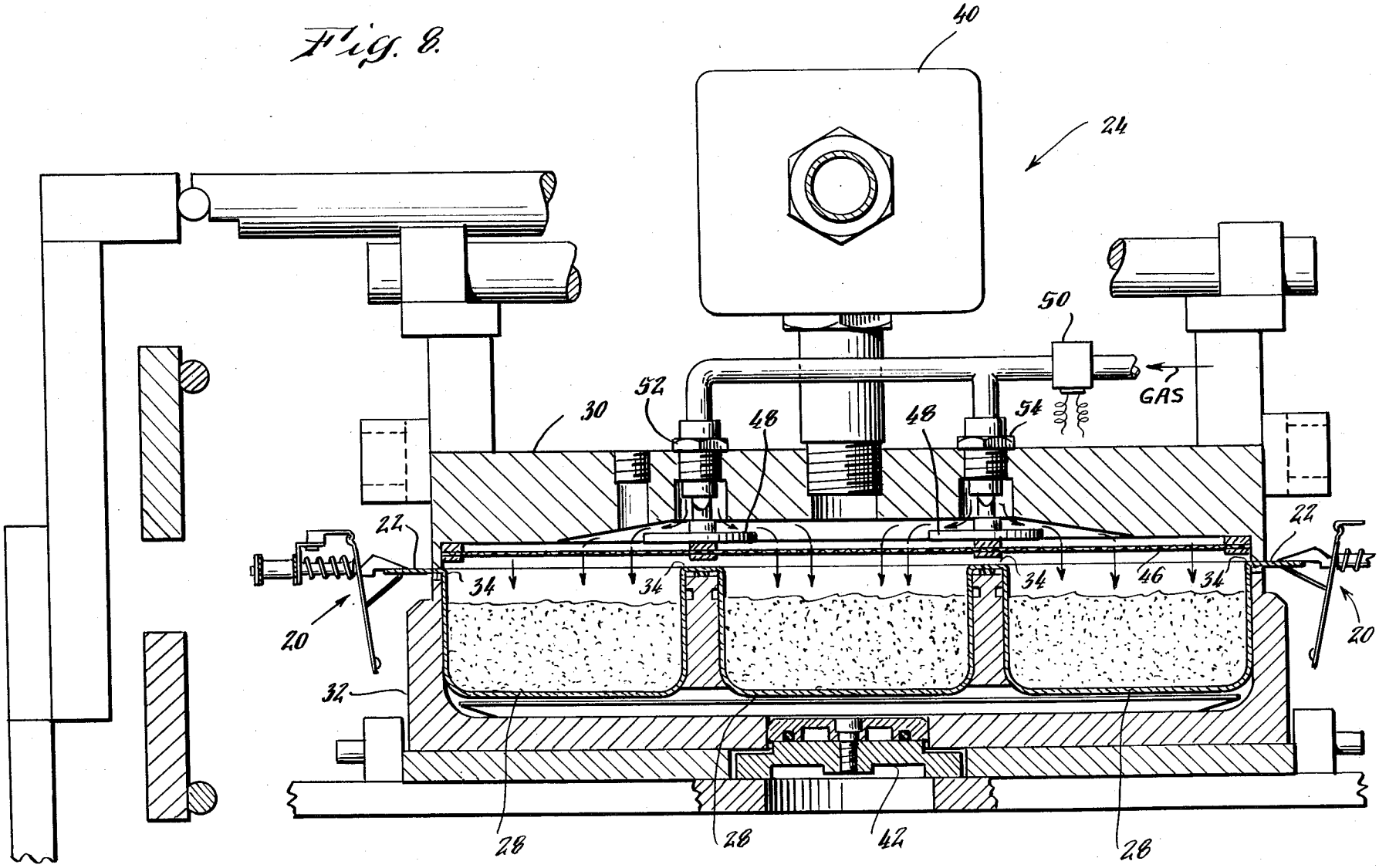
FIG. 8 is a cross-sectional view particularly showing aspects of the evacuate/gas chamber.

Referring also to FIGS. 3 and 5, the first packaging station 24 entered by the product-loaded receptacles 28 includes a fixed chamber 30 located above the web line, and a vertically-movable die 32 below the web line. This die is reciprocated vertically in synchronism with the indexing of the web 22 by conventional means. While the die is in its lower position, a set of receptacles is advanced into the station 24, and after the receptacles come to rest, the die is shifted upwardly to a position surrounding the receptacles. The side walls of the die engage the flanges 34 of the receptacles, and press these flanges up against corresponding walls of the fixed chamber 30, to seal the receptacles from outside atmosphere. The bottom of the fixed chamber is open, so as to establish communication with the interior of the receptacles.

With the die 32 in its upper (seal) position, a valve 40 is opened to connect vacuum to the fixed chamber 30 (see also FIGS. 9–12). Simultaneously, vacuum is applied to the die 32 through a passage 42, to equalize the pressures above and below the receptacles, in known fashion. The vacuum applied to the fixed chamber 30 evacuates the air from the receptacles 28. Because the fixed chamber is open across the entire area of the receptacles, evacuation takes place very rapidly, and also very completely, i.e. more air is withdrawn in a given time than in conventional evacuation techniques where the air must pass through passageways of relatively small cross-section.

In accordance with one aspect of the present invention, means are provided to constrain the air flow out of the receptacles 28 to a substantially vertical direction. In the specific illustrated embodiment, this is effected by a wire-mesh screen secured to the lower surfaces of the fixed chamber 30 and constructed to cover fully the entire area of the receptacle openings. This screen is formed of very fine mesh, e.g. 100 wires/inch in both directions, with a wire diameter of 0.0045".

As the air is drawn up away from the product during evacuation of the receptacles 28, it is forced, by having to pass through the openings of the screen 46, to move in flow lines which are substantially perpendicular to the horizontal surfaces of the product. That is, the air is prevented from moving laterally across the surface of the product. Thus, evacuation of the air from the receptacles, even though at a very rapid rate, does not tend to disarrange the upper surface or upper layer of the product.

After evacuation of the receptacles 28 is complete, the vacuum valve 40 is closed, and a gas valve 50 is opened to admit an inert gas through a pair of inlets 52 and 54 in the roof of the fixed chamber 30. The gas entering the chamber strikes deflector discs 46, 48 which serve to disperse the gas and spread it laterally, to provide for generally uniform distribution of the gas across the surface of the screen 46. As during evacuation, the screen serves to force the gas to flow down to the receptacles in generally vertical flow lines, substantially perpendicular to the upper surface of the contained product. Thus, the movement of the gas into the receptacles does not tend to disarrange the product.

When gassing of the receptacles 28 has been completed, the fixed chamber 30 is at atmospheric pressure or slightly above. The die 32 then is vented to atmosphere, and the die is reciprocated downwardly away from the receptacles. Thereafter, the receptacles are indexed to the left one step, to be positioned in the next packaging station 26. During this movement a film 60 of plastic packaging material is laid down over the receptacles, to serve as closure tops when sealed to the receptacles.

While the gas-filled receptacles are being moved out from under the fixed chamber 30, the receptacle openings are substantially isolated from atmosphere, and a continuously replenished layer of gas is developed over the receptacle openings to maintain a proper gas level therein until they reach the sealing station 26. For these purposes, there is provided immediately to the left of the fixed chamber 30, and beneath the top film 60, a bar structure 70 which forms one wall of an enclosed isolation region 72 above the openings of the receptacles. This bar also serves as a gas header to supply gas to the isolation region, the gas flowing from a supply line 74 through interior passages 76 and out through gas apertures 78 opening to the left, close to the top film 60 which forms the remaining surface defining the isolation region. The gas in this isolation region serves in effect as a "gas curtain" over the receptacle openings, to maintain the desired level of gas in the receptacles until they are completely covered by the top film 60. The slight positive pressure of the gas in the region serves to exclude air from the space.

The top film 60 passes around a roller 80 and engages a pair of guide plates 82 at opposite sides of the isolation region 72. These guide plates are curved, as shown, and provide continuous contact with the film to prevent excessive gas leakage from the isolation region. At the lower end of the guide plates, the film engages a lay-down bar 86 which smoothly applies the film over the openings of the gas-filled receptacles 28 as they move into the sealing station 26. Once this top film is in place over the receptacles, there will be no significant leakage of the gas from the receptacles during the short period before final sealing. To aid in achieving this result, the machine may be provided with side strips which press against the upper surface of the top film 60 where it lies against the side flanges of the two outer receptacles.

Figure 9:
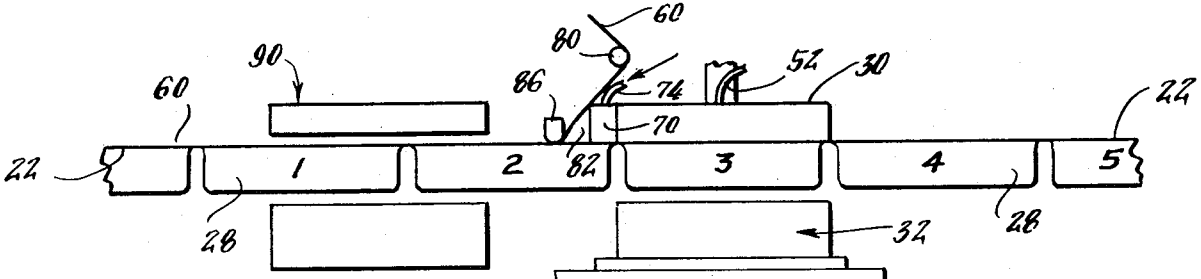
FIGS. 9–12 are diagrammatic representations showing the sequence of operations for two successive cycles.
Figure 10:
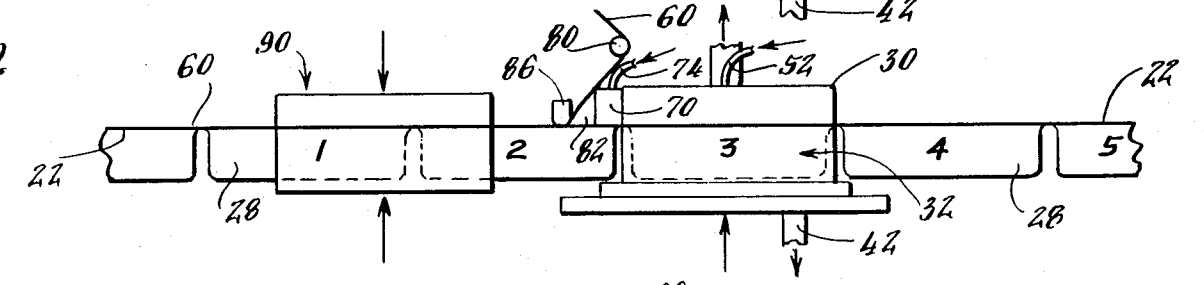
Figure 11:
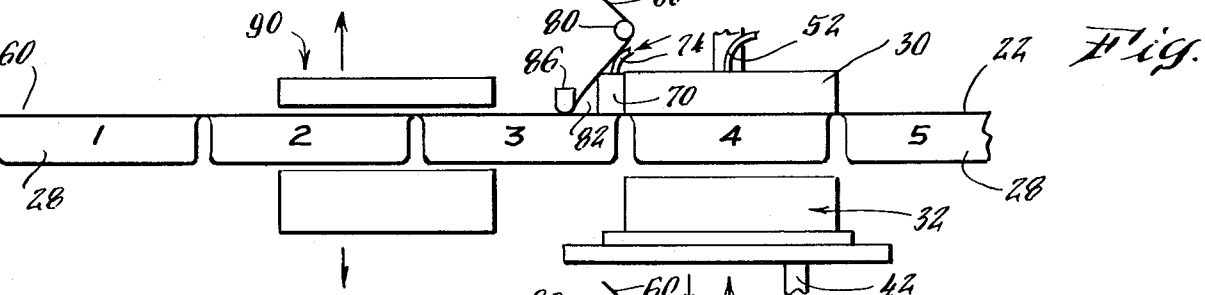

The sealing station 26 comprises an upper sealing head 90 and a lower sealing die 92, both of which reciprocate vertically, towards and away from the web line 22, in synchronism with the indexing movement of the receptacles 28. When these receptacles are in position in the sealing station, the sealing head and sealing die move towards the web into sealing position. This is illustrated in FIGS. 9 and 10, which show receptacles "2" in position in the sealing station.

Figure 12:
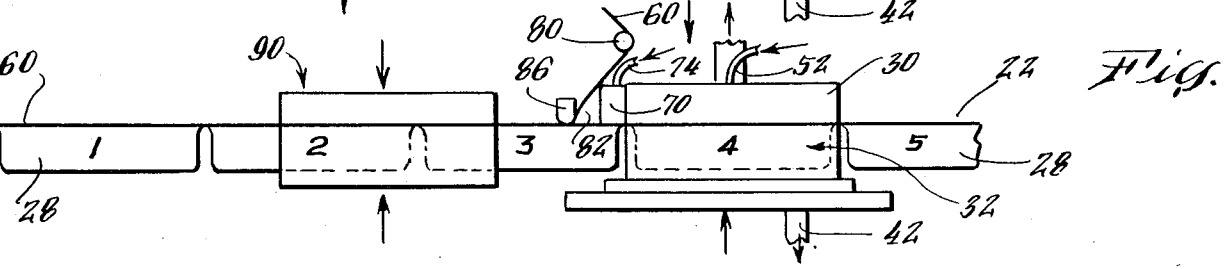

As shown particularly in FIG. 6, the sealing head 90 comprises sealing bars which are split longitudinally into two segments 94A and 94B. With the receptacles in the first sealing station position indicated at "2" in FIGS. 9 and 10, the first sealing bar segment 94A operates to seal the receptacle to the top film 60 in a limited portion thereof having a longitudinal extent less than the full length of the receptacle. Thereafter, the sealing head and sealing die separate (FIG. 11) to permit the receptacles "2" to advance into the second position in the sealing station 26. In this position, the second sealing bar segment 94B functions, when in sealing position as shown in FIG. 12, to complete the final sealing of the package.

It will be seen from the above description that the sealing function is completed in two steps, i.e. in two indexes of the receptacles, with a limited portion (longitudinally) being sealed in a first position, and the remainder in a second position. Since the first-sealed portion is less than a full repeat length, the sealing head and die can be located a selected distance away from the fixed vacuum/gas chamber 30, conveniently providing space for the lay-down of the top film 60, and for establishing the isolation and gas-curtain region 72 over the receptacle just prior to lay-down of the top film.

Referring also to FIGS. 2 and 3, the apparatus may with advantage also include a plexiglas shield 96 extending from the fixed chamber 30 back along the web line 22 for a distance of one to two repeats. Such shield tends to protect the receptacles from environmental effects in the machine area, such as strong drafts and the like. It may be noted that from the time the receptacles enter under the shield until they are sealed, they are covered and isolated from ambient atmosphere, first by the shield, then by the fixed chamber 30, and finally by the top web 60.

In the preferred embodiment the timing of the pertinent events involved in evacuating and gassing the receptacle 28, related in degrees of a 360° machine cycle, were as follows:

| | |
|---|---|
| Die close | 130° |
| Bottom vacuum open | 139° |
| Top vacuum open | 142° |
| Bottom vacuum close | 278° |
| Top vacuum close | 278° |
| Gas on | 278° |
| Bottom vent | 320 |
| Die open (lowers) | 348 |
| Index start | 24 |
| Gas off | 24 |

The gas-on time is extended beyond the end of the machine cycle to be sure that any drooping of the loaded receptacles when the dies are lowered will not draw in air. Horizontal supports are provided below the path of movement of the receptacles to engage the inter-pocket flanges so as to provide support for minimizing sagging during movement. In some applications, it may be desirable to include ramp-like supports beneath the path of the central portions of the receptacles, to further prevent sagging of the receptacles as they advance through the sealing station. Such ramp support can serve to gently lift up the receptacle bottom surfaces as they move by, thereby tending to maintain positive pressure within the receptacles prior to sealing, and to controllably expel some gas before sealing to avoid a ballooned appearance to the finished package.

Although a preferred embodiment of this invention has been described hereinabove in detail, it is desired to emphasize that this has been for the purposes of illustrating the invention, and should not be considered as necessarily limitative of the invention, it being understood that many modifications can be made by those skilled in the art while still practicing the invention claimed herein.

I claim:

1. Packaging apparatus wherein receptacles with upward-facing openings, and containing semi-liquid disarrangeable products, are moved along a line of advance passing through a series of packaging stations where packaging operations are performed, said apparatus comprising:

chamber means at one of said stations presenting a downwardly facing opening;

means to support said receptacle beneath said chamber opening;

said chamber means including means sealingly engageable with said support means to carry out packaging operations while in sealed communication with the receptacle;

vacuum means connected to said chamber means to evacuate receptacles positioned therebeneath while sealingly engaged therewith;

gas supply means connected to said chamber means and operable while a receptacle is in evacuated condition and sealingly engaged with said chamber means to deliver gas to the receptacle;

control means including a screen supported beneath said chamber means for assuring that the air is evacuated from the receptacles substantially perpendicularly with respect to the upper surface of the product throughout substantially all of the areas thereof and to assure that the gas is delivered thereafter to the receptacle with the same perpendicular relationship;

top film lay-down means located downstream from said chamber means and arranged to apply a cover film over a gas-filled receptacle as it is moved out of said one station, said film being disposed along a path having a downward component of motion leading towards engagement with the receptacle;

second gas supply means located downstream from said chamber means and near said top film lay-down means, said second gas supply means comprising means to produce a flow of gas into the region which lies directly beneath the top film portion which is moving downwardly towards the receptacle and approaching the position where it engages the receptacle;

wall means including said top film portion confining the gas supplied by said second gas supply means and thereby developing a curtain of gas overlying the gas previously placed in the receptacle by said first gas supply means to prevent displacement of that previously placed gas as the receptacle moves to the next station;

said top film serving after engagement with the receptacle as the cover to hold the gas in the receptacle until said next station is reached; and sealing means at said next station operable after said cover film has been placed over the receptacle to effect a hermetic seal between said cover film and the receptacle with the gas contained therein.

2. Apparatus as claimed in claim 1, wherein said wall means further comprises a gas header with gas apertures continuously supplying gas to said region.

3. Apparatus as claimed in claim 2, wherein said gas header is a bar structure located immediately adjacent said chamber means;

said apertures being formed on the side of said bar structure which is remote from said chamber means and directing a gas stream towards the cover film as it passes through said path part.

4. Apparatus as claimed in claim 1, wherein said sealing means is operable in two successive positions of a receptacle moving along said line of advance;

said sealing means including first means operable in said first position to effect a seal having a longitudinal extent less than the length of the receptacle; and said sealing means including second means operable in said second position to effect a seal along the remaining longitudinal extent of the receptacle, to complete the sealing of the package.

5. Apparatus as claimed in claim 1, including shield means positioned above said receptacles in a portion of the path of movement thereof just preceding said chamber means.

6. Apparatus as claimed in claim 5, wherein said shield means comprises a generally flat plastic member extending a longitudinal distance equal to at least one repeat of the receptacle.

7. Apparatus as claimed in claim 1, wherein said chamber means is fixed in position relative to the line of movement of said receptacles;

said support means comprising a die which is movable vertically towards and away from the line of receptacles, and operable to engage and press flanges of the receptacles against the fixed chamber to effect sealing therebetween.

8. In a packaging machine of the type wherein product-loaded cup-shaped receptacles are processed in a series of packaging stations to make a complete, hermetically-sealed package having a plastic top sealed to flanges around the mouth of the receptacle, and wherein the upper surface of the product is coextensive with said receptacle mouth; means for evacuating such receptacle without disarranging the product; comprising:

chamber means positioned above the path of movement of the product-loaded containers;

a reciprocable die below said path of movement, said die being movable up into a seal position surrounding a receptacle and sealing the receptacle flangers against said chamber;

vacuum means connected to said chamber and operable when a receptacle is sealed thereto to evacuate the receptacle through at least substantially the entire mouth of the receptacle, whereby to withdraw air simultaneously from all of the upper surfaces of the product;

gas supply means in the roof of said chamber means to supply gas to an evacuated receptacle;

flow control means comprising a screen positioned between said chamber means and a receptacle sealed to said chamber means, said flow control means being operable, during evacuation of the receptacle, to constrain the air flow from above said upper product surfaces to a direction perpendicular to the product surface thereby to prevent disarrangement of the product during evacuation;

said gas supply means comprising dispersal means for controlling the flow of gas to spread it over said screen so as to provide for generally uniform distribution of the gas across the surface of the screen, thereby enhancing the ability of the screen to provide for perpendicular flow of the gas into the receptacles.

9. Apparatus as claimed in claim 8, wherein said gas supply means comprises deflector means in said chamber means to disperse the gas and spread it over said screen.

10. A method of packaging products having at least an upper layer of liquid material comprising the steps of:

placing the product in a cup-shaped receptacle formed of sealable plastic packaging material, said receptacle having side walls with planar flanges at the upper edges thereof to receive a cover to be sealed to the flanges;

moving the receptacle along a straight-line path past a series of stations and with the receptacle mouth facing upwards;

positioning said receptacle beneath a chamber at one of said stations;

sealing said receptacle to said chamber entirely around the receptacle mouth;

applying vacuum to said chamber to evacuate air from said receptacle;

controlling the movement of the air flow out of said receptacle and into the chamber such that the air moves in a direction perpendicular to the upper surface of said liquid material throughout all areas thereof and preventing any lateral movement of the liquid out over the side wall flanges of the receptacle which would interfere with the subsequent sealing of a cover to said flanges;

while still maintaining the receptacle sealed to said chamber, applying a gas through said chamber to said receptacle;

controlling the movement of the gas flow into the receptacle such that the gas moves in a direction perpendicular to the upper surface of said liquid material throughout all areas thereof and preventing any lateral movement of the liquid out over the side wall flanges of the receptacle which would interfere with the subsequent sealing of a cover to the flanges;

moving the receptacle away from said chamber and towards a sealing station;

applying a plastic cover to said receptacle while being moved to said sealing station, thereby to form a complete package; and sealing said cover to said side wall flanges of said receptacle while in said sealing station.

11. The method of claim 10, wherein said air and gas flow is controlled by interposing a relatively fine screen between said receptacle and said chamber.

* * * * *